United States Patent [19]

Lacy

[11] 4,219,158

[45] Aug. 26, 1980

[54] LIQUID MIXING DEVICE FOR A SHOWER HEAD

[76] Inventor: Carl B. Lacy, 3727 Pinevale Rd. SW., Roanoke, Va. 24018

[21] Appl. No.: 48,723

[22] Filed: Jun. 15, 1979

[51] Int. Cl.[2] ..... B05B 3/04

[52] U.S. Cl. ..... 239/305; 239/317; 239/383

[58] Field of Search ..... 239/305, 310, 317, 318, 239/383, 389, 214.25, 224, 451, 452

[56] References Cited

U.S. PATENT DOCUMENTS

| | | | |
|---|---|---|---|
| 3,083,915 | 4/1963 | Gravel | 239/310 |
| 3,454,229 | 7/1969 | Armond | 239/318 |
| 3,612,404 | 10/1971 | Vicari | 239/317 |
| 3,801,018 | 4/1974 | Plotz | 239/383 |

*Primary Examiner*—Robert W. Saifer
*Assistant Examiner*—Michael J. Forman
*Attorney, Agent, or Firm*—Robert S. Auten

[57] ABSTRACT

A device in combination with a shower head supplied by water under pressure, which device includes a container for storing a liquid or liquids to be selectively mixed with water delivered from the shower head. A liquid delivery path supplies liquid from the container to a location downstream of a water spray forming portion in the shower head, ths path including a valve arrangement for manual control by the shower head user so as to control the delivery and rate of delivery of the liquid. A mixer disc at the downstream location is adapted to be rotated by water jets formed upstream at the spray forming portion of the shower head. The mixer disc is designed to receive, at a central portion thereof, liquid from the liquid delivery path, the action of the revolving disc being such that any received liquid is flung outwardly into the water spray for intimate mixing therewith.

8 Claims, 6 Drawing Figures

FIG. 1
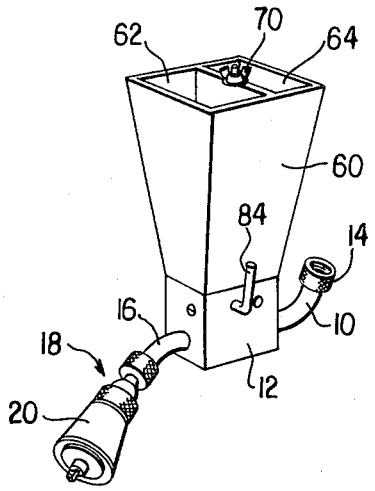
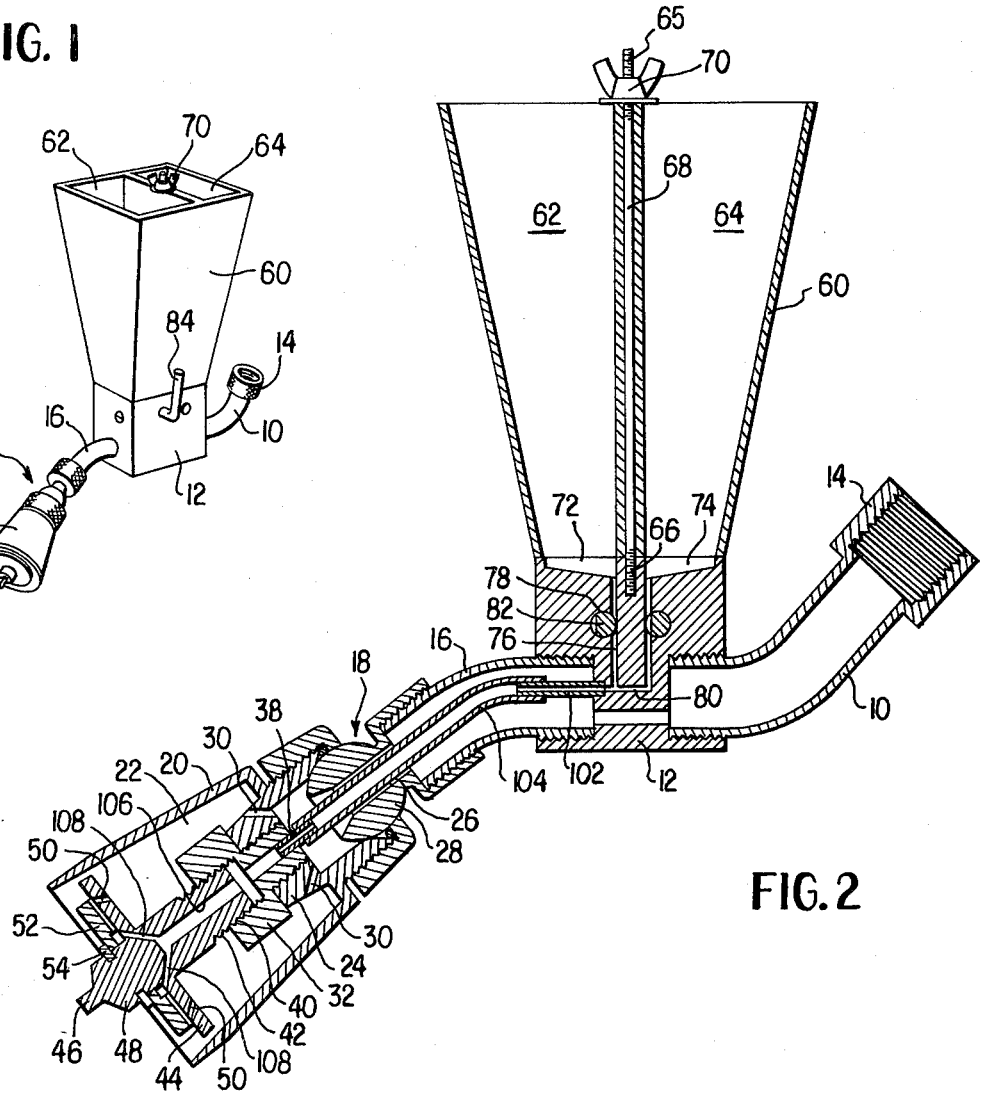
FIG. 2
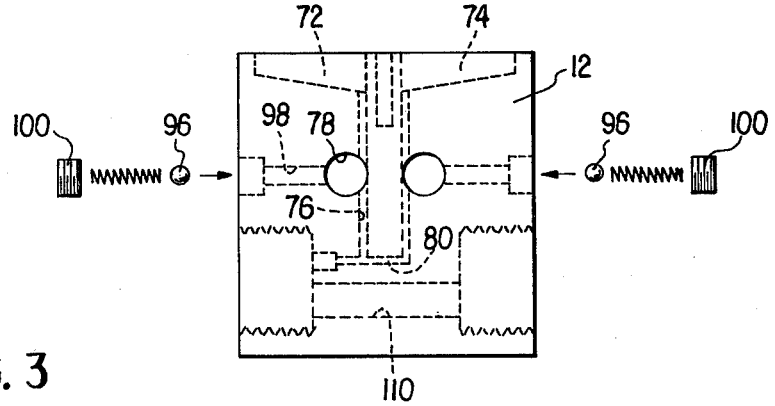
FIG. 3

LIQUID MIXING DEVICE FOR A SHOWER HEAD

BRIEF SUMMARY AND OBJECTS OF THE INVENTION

A number of arrangements have heretofore been suggested for use with shower heads so as to provide a means for mixing various liquids, such as soap, shampoo, body oils, etc., with the water delivered from the shower head to the body of a user. Apparently the various arrangements have met with various degrees of success due to complexity of design, incomplete mixing of the liquids with the water due to pressure of the water or the injection point, etc..

It is an object of the present invention to provide a device which can be incorporated into the typical shower head arrangement, with relatively little modification thereof, to provide for the controlled introduction of liquids into the water after it has passed the spray or jet forming portion of the shower head.

It is a further object of the invention to provide in the device, as according to the invention, a mixing disc which is rotated by water passing through the shower head in order to fling the liquid into the water as it exits from the shower head.

DESCRIPTIONS OF THE DRAWINGS

FIG. 1 is a perspective view of the device as seen in assembled relationship with a shower head and a connecting pipe to a supply of water.

FIG. 2 is a detailed sectional view of the arrangement of FIG. 1.

FIG. 3 is a side elevational view of the valve body showing the spring-loaded ball detents, which are associated with the valve body, in position to be inserted into the body.

DESCRIPTION OF PREFERRED EMBODIMENT OF INVENTION

Figure 5:
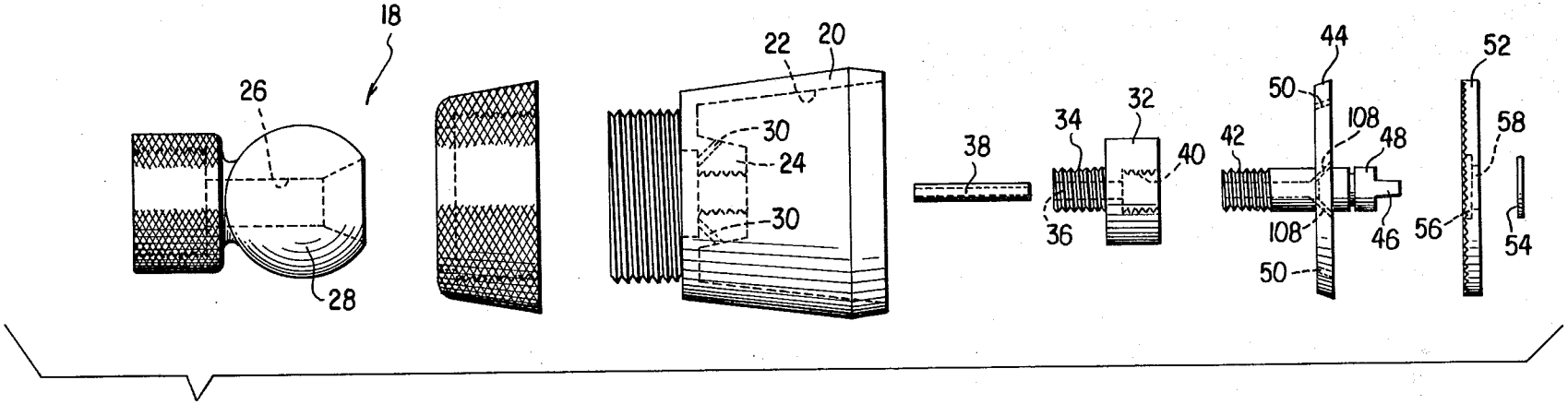
FIG. 5 is an exploded view of the components found in the shower head and the ball and socket arrangement seen in the lower left hand portion of FIG. 2.

As seen in FIGS. 1 and 2 one end of a pipe 10 is threadably received in a valve body 12 at its other end there is an internally threaded portion 14 adapted to be connected to a water supply source, not shown, associated with a suitable valve, not shown either, to control the supply of water delivered from the source.

Also threadably received in the valve body 12 is another pipe 16 which supports at its other end, by means of a well known ball and socket arrangement, generally indicated at 18, a shower head 20 having a chamber 22.

Turning also to the exploded view as seen in FIG. 5 it can be seen that the shower head 20 has a portion 24 which is internally threaded to normally receive the externally threaded end of a shaft. Typically this shaft carries a plate at its opposite end, which plate is disposed near the open end of chamber 22 and has grooves or slots along its peripheral edge and/or holes through it so that water flowing into chamber 22 is emitted in the form of a spray or as jets from the shower head 20. As will be described below this typical arrangement is modified according to the invention.

As is well understood in conjunction with such a typical shower arrangement water, under pressure, is supplied to chamber 22 through a passage 26 in the ball 28 of the ball and socket arrangement 18 and through passageways 30 in portion 24.

According to my invention I provide for an adapter 32 having an externally threaded portion 34, which is designed to be threadably received in portion 24, and having a passageway 36 into which a short tube 38 of suitable material is press fitted with a short end portion projecting outside portion 24 and directed toward ball 28.

An internally threaded portion 40 of adapter 32 is designed to receive an externally threaded portion of a shaft 42 carrying a plate 44 and an adjustment tab portion 46 at the end of a shaft portion 48. The plate 44 in operative position, as seen best in FIG. 2, has its periphery in spaced relationship with shower head 20 so as to cause the water to leave the head in the form of a spray. Suitable grooves or notches, not shown, can be provided around the periphery of plate 44 as desired and by turning tab portion 46 the shower user can adjust the spray of water.

As seen in FIGS. 2 and 5 plate 44 has a plurality of holes 50 extending through it and while only two such holes are seen I have found that for the best results, as will be explained later, it is best to provide three holes angularly spaced from each other at approximately 120°.

In front of plate 44, i.e. toward the open end of shower head 20, a grooved mixer disc 52 is rotatably mounted on shaft portion 48. Disc 52 is maintained in close proximity to plate 44 by means of a snap ring 54 on shaft portion 48. The disc 52 has an enlarged portion at its central opening 58 to form a chamber 56 and the purpose of this chamber will be explained below.

Figure 6:
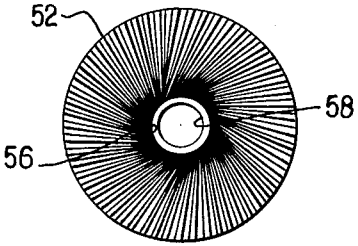
FIG. 6 is a front elevational view of the grooved mixer disc showing the grooves extending radially from the area of the rotational axis thereof.

As seen best in FIG. 6 the grooves in the disc 52 extend outwardly from the periphery of the enlarged portion 56 and widen toward the periphery of the disc 52. These grooves are formed off center of the disc 52.

Turning back to the holes 50 in plate 44 it should be pointed out that the longitudinal axis of such holes is inclined outwardly with respect to the central axis of the disc, as seen in FIG. 5, and also is inclined with respect to the respective inner and outer wall surfaces of plate 44.

These holes 50 serve to direct water, received under pressure in chamber 22, forwardly in the form of jets against the grooved face of mixer disc 52 near the outer periphery thereof, and this causes the disc to rotate rapidly.

The container for the liquid to be mixed with the shower water is shown at 60 in FIGS. 1 and 2 and two compartments 62 and 64 are provided to receive separate amounts of desired liquids such as a liquid soap and a shampoo mixture. Container 60 is mounted on top of valve body 12 by means of a stud 65, one end of which is threaded into the valve body at 66. The stud extends upward through the space 68 between the compartments 62 and 64 and is tightened against the container by means of a wing nut 70, seen in FIG. 1.

The lower ends of compartments 62 and 64 are open to permit liquid flow to chambers 72 and 74, respectively, located on the top of valve body 12. The flow of liquid from both chambers is controlled and directed in the same manner so, in the interest of brevity, only the flow path from chamber 72 will be described.

Figure 4:
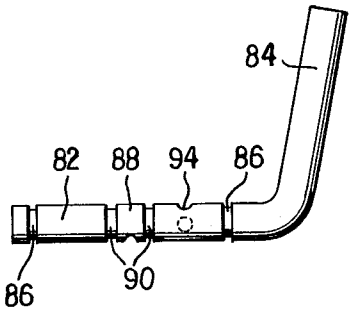
FIG. 4 is a side elevational view of one of the valve control arms which is operatively carried in the valve body and is engaged with the ball portion of one of the detents shown in FIG. 3.

Attention is directed to FIGS. 2 and 3 where it will be seen that a passageway 76 leads downwardly from chamber 72 and is enlarged at 78 before it meets with passageway 80 connected to a similar passageway arrangement leading down from chamber 74. The enlarged portion 78 is aligned with holes designed to receive a valve control arm 82, shown in FIG. 4, having a handle 84 as seen in FIG. 1.

The valve control arm 82 is retained in the valve body 12 by means of snap rings, not shown, received in grooves 86, and a central portion 88 is edged by "O" rings, not shown, received in grooves 90 in the valve control arm. This central portion 88 has a metering passageway 92 which, when the valve control arm is positioned within the valve body, is in alignment with passageway 76 and it will be understood that a shower user by grasping handle 84 and turning it can regulate the flow of liquid down the passageway 76 and, of course, can turn off the flow of liquid when desired. A plurality of indentations 94 are provided in the valve control arm to selectively receive a spring-loaded ball 96 received in opening 98 in the valve body and retained in the valve body by a plug 100. This arrangement provides for the valve control arm 82 to be positioned by the shower user and to be retained at a desired position.

A short tube 102 of desired material is pressed into valve body 12 in a position to connect with passageway 80 and extend from the valve body 12 in the direction of the shower head 20 as seen in FIG. 2. One end of a flexible tube 104 of suitable material, such as plastic, is pressed on to the tube 102. Tube 104 extends through the pipe 16, passage 26 in ball 28 and its other end is pressed onto tube 38 received in passageway 36 of adapter 32. Passageway 36 is, as seen in FIG. 2, aligned and in communication with a passageway 106 in shaft portion 42 that carries plate 44. Passageway 106 terminates adjacent plate 44 but passageways 108 branch off the passageway 106 and extend at such angles through plate 44 that they open into the chamber 56 in the grooved mixer disc 52.

With the above-described arrangement the shower user can control the supply of a desired liquid from the compartments in container 60 to the enlarged portion 56 of mixer disc 52 and it should be noted that the flow of liquid is entirely under the influence of gravity. Thus liquid flows, when valve control arm 82 is placed in an on position by the shower user, through passageway 76 and 80, through flexible tube 104, through passageways 36 and 106, and is discharged to the mixer disc 52 via passageways 108. Up to this point there has been no mixing of the liquid with water and therefore no effect of water back pressure impeding or stopping the flow of liquid.

The flow of water, after the shower is placed in use, is via pipe 10, passageway 110 in valve body 12, passage 26 in ball 28, passageways 30 and into chamber 22. From this chamber the water is emitted in the form of a spray or jets, as in a conventional shower arrangement, and, as according to the invention, is emitted also, through holes 50 in plate 44, in the form of propulsive jets against the grooved mixer disc 52 to rotate it as previously described. The liquid flowing into the enlarged portion 56 of the mixer disc 52 flows through the grooves and is flung, after mixing with the water at the propulsive jets, into the spray of water formed by the passage of water around the plate 44. This ensures an intimate mixture of the liquid and water and this result is achieved by the delivery of the liquid under the influence of gravity only. Of course the flow paths of the liquid and the water is under the control of the shower user.

In use the shower user would adjust the temperature of the water sprayed from the shower head as in a conventional shower. At the time desired by the user he simply grasps the handle 84 of the valve control arm he wishes to use to adjust the flow of liquid from the compartment of the container 60. As previously explained the invention provides for the intimate and complete mixing of the liquid, thus released by the user, with the spray of water being emitted from the shower head. This, of course, produces suds or a lather which the user receives on his body for the desired period of time after which he can turn off the supply of liquid by grasping handle 84 and turning it. The shower can be completed by rinsing in clear water.

What I claim is:

1. In combination with a shower head selectively supplied with water, under pressure, conducted by a pipe system from a source of supply, a device for mixing liquid with the water as it issues from the downstream side of the shower head, such device including:

a. a container for holding a supply of the liquid and said container is supported in an upright position at a location upstream of, and above, the level of the shower head;

b. a valve system disposed between an exit end of said container and an entrance end of a liquid conducting means, which means terminates at an exit end at the downstream side of the shower head, said valve system being manually operable by a shower user to control the delivery and rate of delivery of liquid, flowing under the influence of gravity, from said container to said exit end;

c. a mixer disc rotatably mounted downstream of, and adjacent to, a plate member which is adjustably carried within the shower head with said plate member having a peripheral wall surface lying adjacent to an inner wall of said shower head and permitting water to flow therebetween, said disc having one wall surface with a plurality of radially extending grooves facing one wall of said plate member, said grooves opening radially toward the axis of rotation of said disc, into a chamber in said disc and at their opposite ends towards said inner wall of the shower head, said chamber being in facing relationship with the exit end of said liquid conducting means, a portion of such means extending through said plate member;

d. means defining a plurality of openings extending through said plate member, said openings having downstream exit ends facing said grooves in said disc near the periphery thereof, whereby a portion of the water flow through the shower head is directed through said openings to issue as jets against the grooved surface to cause said disc to rotate, the rotary movement of said disc being effective to sling liquid, being received in said chamber of said disc, radially outwardly through said grooves into the water flowing between the inner wall of the shower head and said peripheral wall surface of said plate member.

2. A device as claimed in claim 1 wherein said container is supported on the pipe system and said entrance end of said liquid conducting means is located within the pipe system.

3. A device as claimed in claim 2 wherein said liquid conducting means is located within the water flowing through the pipe system and shower head.

4. A device as claimed in claim 3 wherein at least a portion of said liquid conducting means is flexible so as to accommodate movement of the shower head with respect to the pipe system.

5. A device as claimed in claim 1 wherein said container has a plurality of compartments for holding separate portions of the supply of liquid and said valve system includes a valve associated with each respective compartment, at exit ends thereof, and being manually operable to control the delivery of liquid from said compartments to said entrance end of said liquid conducting means.

6. A device as claimed in claim 5 wherein each of said valves has a metering portion, through which the liquid passes, to permit the control of the rate of flow of liquid through each of said valves.

7. A device as claimed in claim 1 wherein each of said grooves opens into said chamber of said disc off-center of the axis of rotation of said disc.

8. A device as claimed in claim 1 wherein each of said openings in said plate member so extend that their respective downstream exit ends lie peripherally outward of corresponding upstream entrance ends of said openings and each of said exit ends is off-set in the same direction, circumferentially, from their respective entrance ends.

* * * * *